US005951174A

United States Patent [19]

Handa

[11] Patent Number: 5,951,174

[45] Date of Patent: Sep. 14, 1999

[54] TAPE PRINTERS

[75] Inventor: Yuji Handa, Akishima, Japan

[73] Assignee: Casio Computer Co., Ltd., Tokyo, Japan

[21] Appl. No.: 09/043,345

[22] PCT Filed: Jul. 18, 1997

[86] PCT No.: PCT/JP97/02497

§ 371 Date: May 18, 1998

§ 102(e) Date: May 18, 1998

[87] PCT Pub. No.: WO98/03343

PCT Pub. Date: Jan. 29, 1998

[30] Foreign Application Priority Data

Jul. 23, 1996 [JP] Japan ..... 8-193374

[51] Int. Cl.[6] ..... B41J 2/315

[52] U.S. Cl. ..... 400/120.01; 400/615.2

[58] Field of Search ..... 400/120.01, 615.2, 400/76, 61, 62

[56] References Cited

U.S. PATENT DOCUMENTS

| | | | |
|---|---|---|---|
| 4,939,674 | 7/1990 | Price et al. | 101/93.4 X |
| 5,302,038 | 4/1994 | Hirono et al. | 400/615.2 |
| 5,462,372 | 10/1995 | Hirono | 400/615.2 |
| 5,503,482 | 4/1996 | Kawakami et al. | 400/615.2 X |
| 5,551,785 | 9/1996 | Mori et al. | 400/76 |
| 5,795,086 | 8/1998 | Wantanabe et al. | 400/615.2 |

FOREIGN PATENT DOCUMENTS

| | | |
|---|---|---|
| 0 616 299 A2 | 9/1994 | European Pat. Off. . |
| 0 658 853 | 6/1995 | European Pat. Off. . |
| 0 742 103 A1 | 11/1996 | European Pat. Off. . |
| WO96/16812 | 6/1996 | WIPO . |

*Primary Examiner*—Stephen R. Funk
*Assistant Examiner*—Minh H. Chau
*Attorney, Agent, or Firm*—Frishauf, Holtz, Goodman, Langer & Chick, P.C.

[57] ABSTRACT

When an enlarged character having a height exceeding the width of a tape (T) is printed on a corresponding-sized label, using tape sections (T1, T2, T3), print pattern data for enlarged printing is divided into a plurality of print pattern data portions through the height thereof. The height of the plurality of print pattern data portions are enlarged to that of the tape, combined with a corresponding plurality of predetermined marks (m1, m2, m3), and then printed. The predetermined marks (m1, m2, m3) are each composed of a pattern representing the order of arrangement of a respective one of the plurality of tape sections (T1, T2, T3) on which the corresponding print data portions are printed. The predetermined marks (m1, m2, m3) are printed at a predetermined position along the length of the respective plurality of tape sections (T1, T2, T3). Thus, when the plurality of tape sections (T1, T2, T3) on which the corresponding print data portions are printed are pasted on corresponding objects to be used as a single enlarged label, the correct positions of arrangement of the respective tape sections (T1, T2, T3) in the enlarged label can be confirmed using the patterns of the marks (m1, m2, m3), and the divided printed character portions on the tape sections of the enlarged label are prevented from deviating one from the other by aligning the marks (m1, m2, m3) on the plurality of tape sections (T1, T2, T3).

6 Claims, 8 Drawing Sheets

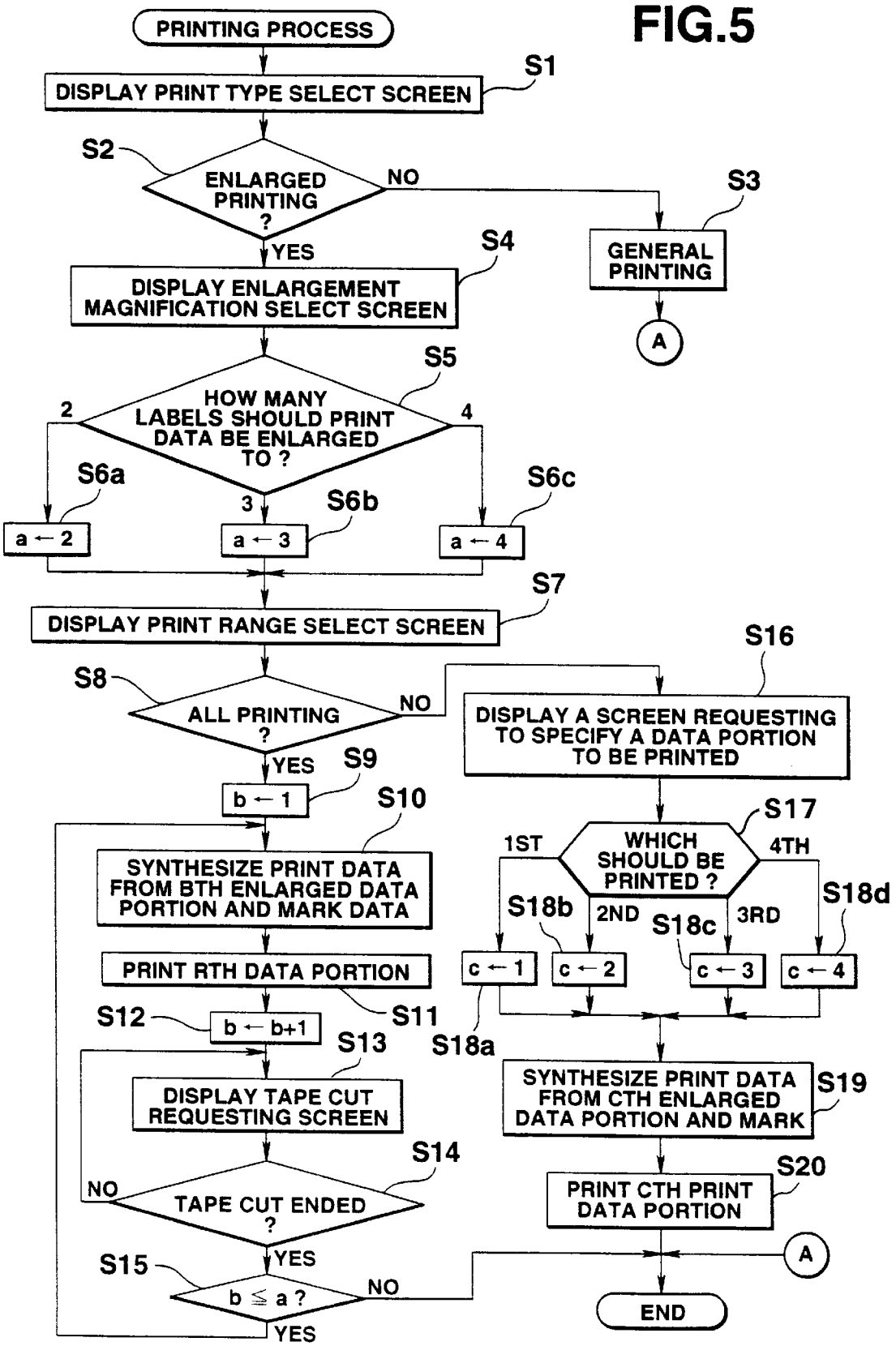
FIG.5
PRINTING PROCESS
DISPLAY PRINT TYPE SELECT SCREEN
S1
S2
ENLARGED PRINTING ?
NO
YES
S3
GENERAL PRINTING
A
S4
DISPLAY ENLARGEMENT MAGNIFICATION SELECT SCREEN
S5
HOW MANY LABELS SHOULD PRINT DATA BE ENLARGED TO ?
2
3
4
S6a
S6b
S6c
a ← 2
a ← 3
a ← 4
S7
DISPLAY PRINT RANGE SELECT SCREEN
S8
ALL PRINTING ?
NO
YES
S9
b ← 1
S10
SYNTHESIZE PRINT DATA FROM BTH ENLARGED DATA PORTION AND MARK DATA
PRINT RTH DATA PORTION
S11
S12
b ← b+1
S13
DISPLAY TAPE CUT REQUESTING SCREEN
S14
TAPE CUT ENDED ?
NO
YES
S15
b ≦ a ?
NO
YES
S16
DISPLAY A SCREEN REQUESTING TO SPECIFY A DATA PORTION TO BE PRINTED
S17
WHICH SHOULD BE PRINTED ?
1ST
2ND
3RD
4TH
S18a
S18b
S18c
S18d
c ← 1
c ← 2
c ← 3
c ← 4
S19
SYNTHESIZE PRINT DATA FROM CTH ENLARGED DATA PORTION AND MARK
S20
PRINT CTH PRINT DATA PORTION
A
END

TAPE PRINTERS

TECHNICAL FIELD

The present invention relates to tape printers which print data on a tape.

BACKGROUND ART

Conventionally, there are tape printers which produce original index labels to be pasted on audio or video cassettes or original name labels to be pasted on our various belongings.

These tape printers each print document data, which were created, using a document creating function, lengthwise on a tape with a printing head which has a plurality of heat producing elements arranged across the tape. The printed tape is discharged through a tape exit to the outside of the printer and cut by a manually or automatically driven cutter disposed between the printing head and the tape exit to produce a label.

Some conventional tape printers each have a so-called an enlarged-label printing function which prints on a tape an enlarged-character string whose height exceeds the width of the tape to produce a label having a width larger than the tape width.

This enlarged-label printing includes printing a plurality of character string portions, into which an enlarged character string is divided by the tape width through the height of the characters, on a corresponding plurality of labels each of which is a tape section.

By arranging the plurality of labels, on which the respective enlarged-character string portions are printed, in predetermined order in the direction of width of the labels, an enlarged-label on which the enlarged-character string is printed is obtained.

When the enlargement magnification of a character string increases and the number of labels on which the divided enlarged character string portions are printed increase in the tape printer having the enlarged-label printing function, it is considerably difficult to know positions in an enlarged label where the individual labels on which divided enlarged character string portions are printed are disposed.

In addition, it is also considerably difficult to align the plurality of printed labels so that the divided enlarged-character string portions do not deviate one from the other even when the positions in the enlarged label where the individual labels on which the divided enlarged-character string portions are printed are known.

In the conventional tape printer having the enlarged-label printing function, a plurality of labels which constitute one enlarged label are printed successively. When an unused tape set in the printing unit of the printer fails during printing of the divided enlarged character labels and the cassette needs to be replaced, printing of one label which constitute a part of the whole enlarged label is unsuccessful. As a result, each and every one of the plurality of labels which constitute the whole enlarged label must be reprinted, which produces a waste of the tape.

Also, even when only one of the plurality of labels which constitute the whole enlarged label is damaged, all of the plurality of labels must be reprinted.

DISCLOSURE OF THE INVENTION

It is therefore a first object of the present invention to provide a tape printer which is capable of enlarged-label printing in which when an enlarged character or character string is divided into a plurality of portions through its height and the plurality of divided character or character string portions are printed on a corresponding plurality of labels, the user is able to clearly know the positions of arrangement of the individual labels and their mutual positions in an enlarged label.

A second object of the present invention is to provide a tape printer which is capable of selecting any one of a plurality of labels which constitute an enlarged label in the enlarged label printing and which is capable of printing the appropriate data on that label.

According to the present invention, there is provided a tape printer comprising:

- input means for entering character data to be printed;
- print head means having a plurality of heat producing elements arranged across a tape;
- enlarged-character print specifying means for specifying the printing of the character data entered by the input means in an enlarged character size whose height exceeds the width of the tape;
- print data producing means responsive to the enlarged-character print specifying means specifying the printing of the character data entered by the input means in the enlarged character size for producing pattern data corresponding to the character data entered by the input means as a plurality of character pattern data portions each having a size corresponding to the tape width and for synthesizing the plurality of character pattern data portions and a corresponding plurality of mark data for representing the order of arrangement of those character pattern data portions and for aligning the respective character pattern data portions to produce a corresponding plurality of print pattern data; and
- print control means for feeding the plurality of print pattern data portions produced by said print data producing means to the print head means to print the plurality of print pattern-data portions lengthwise on the tape while carrying same.

When in such tape printer respective labels which constitute an enlarged printed label are produced by dividing a specified enlarged character through its height into a plurality of character portions and printing the plurality of divided character portions on a corresponding plurality of tape sections, marks which indicate the positions where the individual labels are arranged and permit alignment of their mutual positions are printed on the respective labels. Thus, when the respective printed labels are combined into an enlarged label, the positions of arrangement of the respective labels are easily known, and the respective labels are easily combined and aligned so that no adjacent character portions deviate from each other.

Each mark is provided at a predetermined position in a print pattern which is printed on a respective one of the plurality of labels which constitute the enlarged label. Preferably, each mark is composed of a plurality of dots whose number varies depending on the order of arrangement of the print pattern concerned so that the mark is not striking.

According to the present invention, there is also provided a tape printer comprising:

- a plurality of different types of tape cassettes which contain a corresponding plurality of types of tapes whose printing surfaces are different in color and pattern;
- print means for printing character data on a tape contained in one of the plurality of different types of tape cassettes set removably;

input means for entering the character data;

enlarged character print specifying means for specifying an enlarged character printing process in which the character data entered by said input means is divided into a plurality of print data portions, and the plurality of print data portions are printed in an enlarged character size having a height which exceeds the width size of the tape;

print range specifying means responsive to the enlarged character print specifying means specifying the enlarged character printing process for optionally specifying the range of the character data entered by the input means to be printed in the enlarged character size for any one of the plurality of print data portions;

print data producing means for producing print pattern data by enlarging the print range of a part of pattern data corresponding to the character data entered by the input means and specified by the print range specifying means, in accordance with the enlarged character size specified by the enlarged print specifying means; and print control means for feeding the print pattern data produced by the print data producing means to the print head means to print the print pattern data lengthwise on the tape while carrying the tape lengthwise.

In such tape printer, enlarged label printing can be performed by replacing one of a plurality of different types of tape cassettes, which are different in color/pattern, with another as requested during the enlarged label printing. Thus, a colorful enlarged label is obtained in which tape sections (labels) different in color/pattern are present. A range of enlarged printing can be specified optionally. Thus, when a divided enlarged label is unsuccessful in printing, the unsuccessfully printed label can be specified and only that label need be reprinted. Thus, there is no waste of print to be produced.

Preferably, also, when a desired label is specified and printed, a mark for the order of arrangement of the label and for alignment of labels is printed.

BRIEF DESCRIPTION OF THE DRAWINGS

FIG. 5 is a flow chart of a printing process performed in the tape printer;

BEST MODE FOR CARRYING OUT THE INVENTION

An embodiment of the present invention will be described next with respect to the accompanying drawings.

Figure 1:
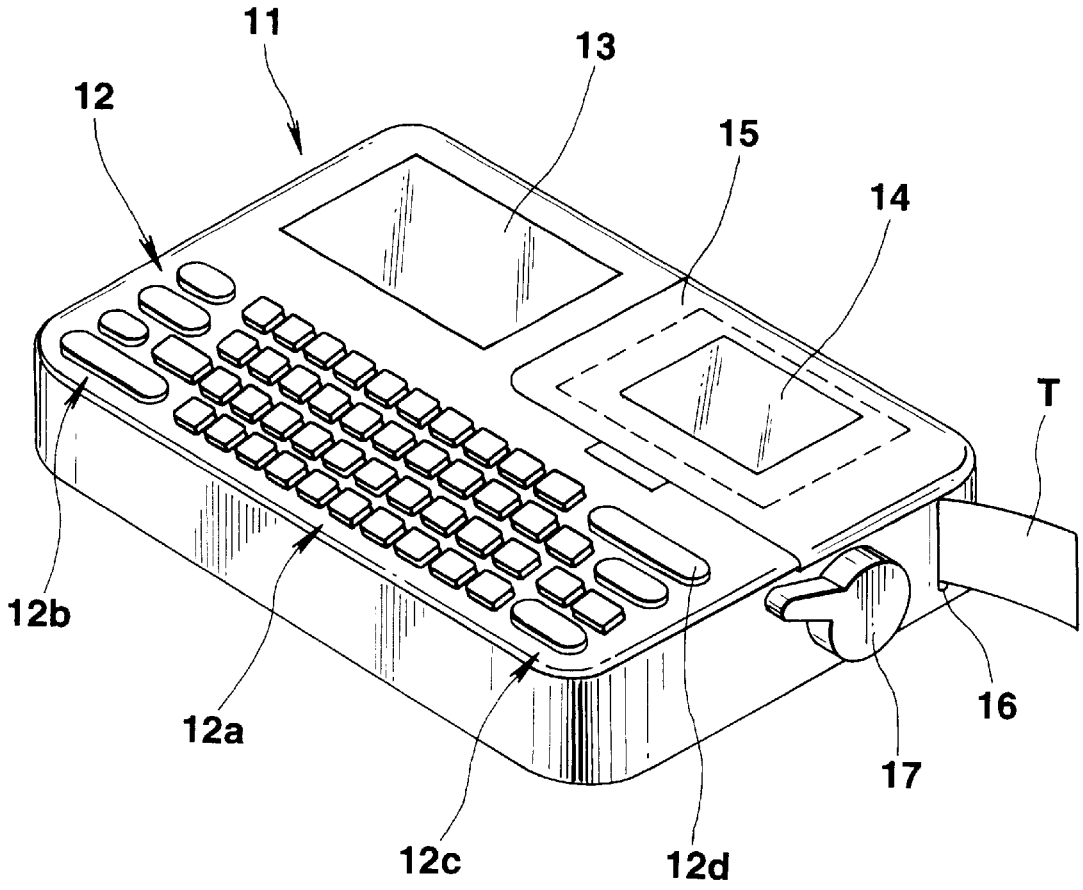
FIG. 1 is a perspective view of a tape printer as an embodiment of the present invention.

FIG. 1 is a perspective view of a tape printer as the embodiment of the present invention.

A printer body 11 has on its front a key-in unit 12 which enters data, instructs the printer to start printing, etc.; a liquid crystal dot matrix display unit 13 for display of the entered data; and a tape cassette accommodating section 14 with an openable cover 15 for setting a printing tape cassettes 30 removably therein.

The key-in unit 12 is provided with character keys 12*a* for entering any character string which will be print data; control keys 12*b*, 12*c* for converting, selecting, fixing various entered data, and setting various functions; and a print key 12*d* for starting print of the entered print data.

The printer body 11 has on its right-hand side a tape exit 16 from which a tape T on which print data is printed in the tape cassette accommodating section 14 is discharged, and a cutter operating dial 17 which manually cuts a printed section of the tape T discharged from the tape exit 16.

Figure 2:
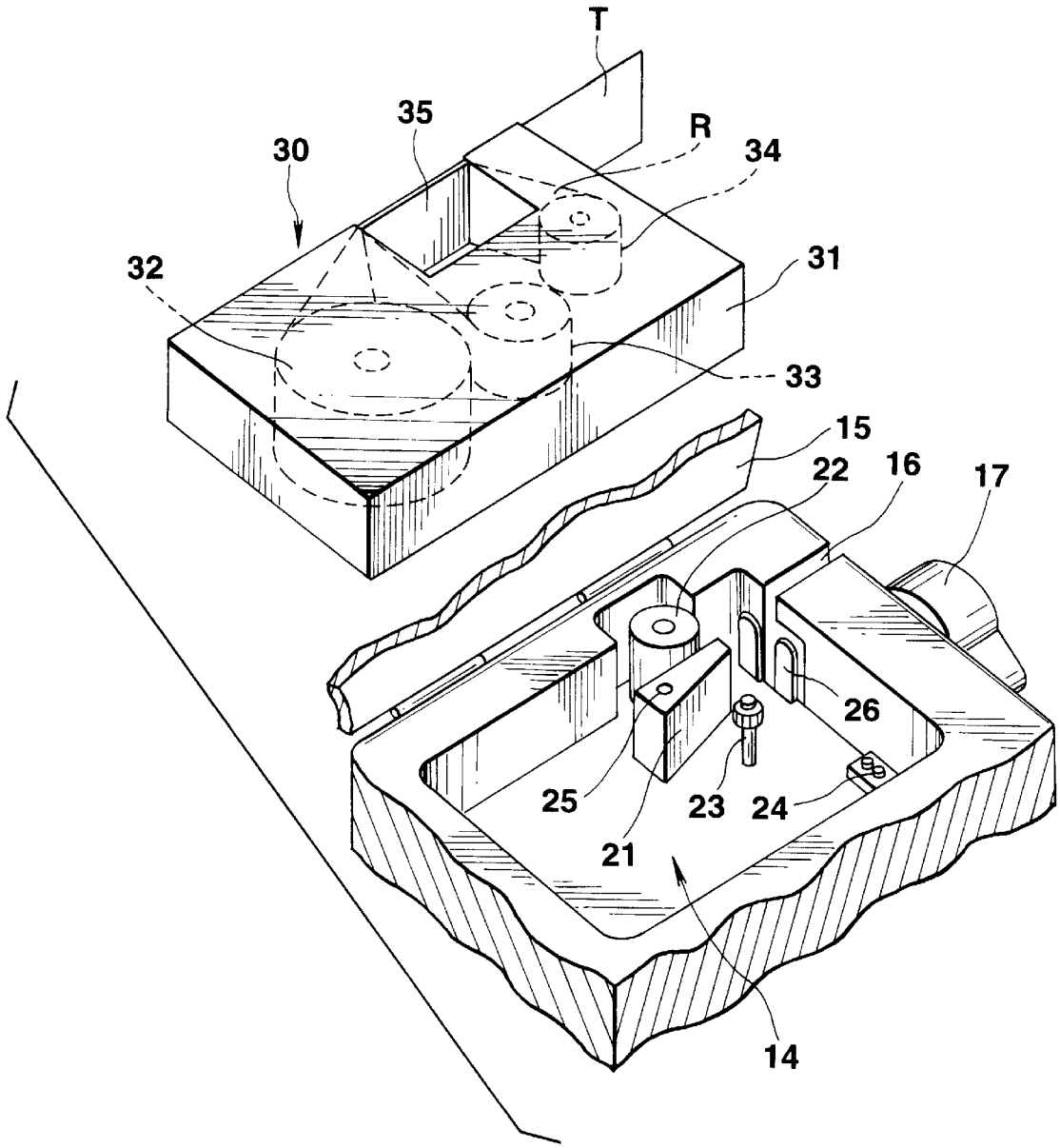
FIG. 2 shows the structure of a tape cassette accommodating section provided in the tape printer body and the structure of a tape cassette accommodated in the cassette accommodating section.

FIG. 2 shows the tape cassette accommodating section 14 provided in the printer body 11 and the tape cassette 30 to be accommodated in the tape cassette accommodating section 14.

As shown in FIG. 2, the main components of the printer are provided in the tape cassette accommodating section 14.

A plurality of heat producing elements (not shown) are arranged in a thermal head 21 across the tape T and an ink ribbon R to cause the heating elements to produce heat on the basis of print data to thereby melt an ink in the ink ribbon R and transfer same to the tape T. The thermal head 21 is turnable by a drive mechanism (not shown) around a head support shaft 25; pressed against a platen roller 22 during printing; and moved away from the platen roller 22 as requested, for example, when the tape cassette 30 is to be replaced with another.

The platen roller 22 is rotated by a transmission mechanism (not shown) along with an ink ribbon winding shaft 23 by a platen/ink ribbon winding shaft drive motor 49 (FIG. 3) during printing to carry the tape T and the ink ribbon R in their lengthwise directions.

The ink ribbon winding shaft 23 is rotated along with the platen roller 22 during printing to wind a used ink ribbon R.

A plurality of cassette type detecting switches 24 (which compose a tape width detector) for detecting the width of the tape T are provided within the tape cassette accommodating section 14. The cassette type detecting switches 24 are each composed of an electrical switch, which abuts on an identification section (not shown) provided in a tape cassette 30 set in the tape cassette accommodating section 14 to be turned on/off. The identification section takes a different shape depending the width of the tape T set in the tape cassette 30. Thus, the output of the switch 24 varies depending on the type of the tape cassette used, and is used as tape width information.

A cutter 26 is provided at the tape exit 16 so that it is driven by the operation of the cutter operation dial 17 to cut the tape.

Reference numerals 32, 33, 34 denote a tape feed spool, ink ribbon feed spool, and ink ribbon winding spool, provided rotatably within the tape cassette case 31. The tape feed spool 32 has a roll of tape T, the ink ribbon feed spool 33 has a roll of ink ribbon R, and the ink ribbon winding spool 34 is fitted over an ink ribbon winding shaft 23.

Reference numeral 35 denotes a head accommodating section in which the thermal head 21 is accommodated, and takes the form of a space provided in the cassette case 31.

The tape T and ink ribbon R fed out from the tape feed spool 32 and ink ribbon feed spool 33, respectively, are arranged to pass in an overlapping manner through the head accommodating section 35 so that the tape T faces the thermal head 21.

The tape T has an adhesive layer (not shown) formed on the back of a resin tape base which provides a printing surface, and a peelable paper strip (not shown) adhering to the adhesive layer.

Figure 3:
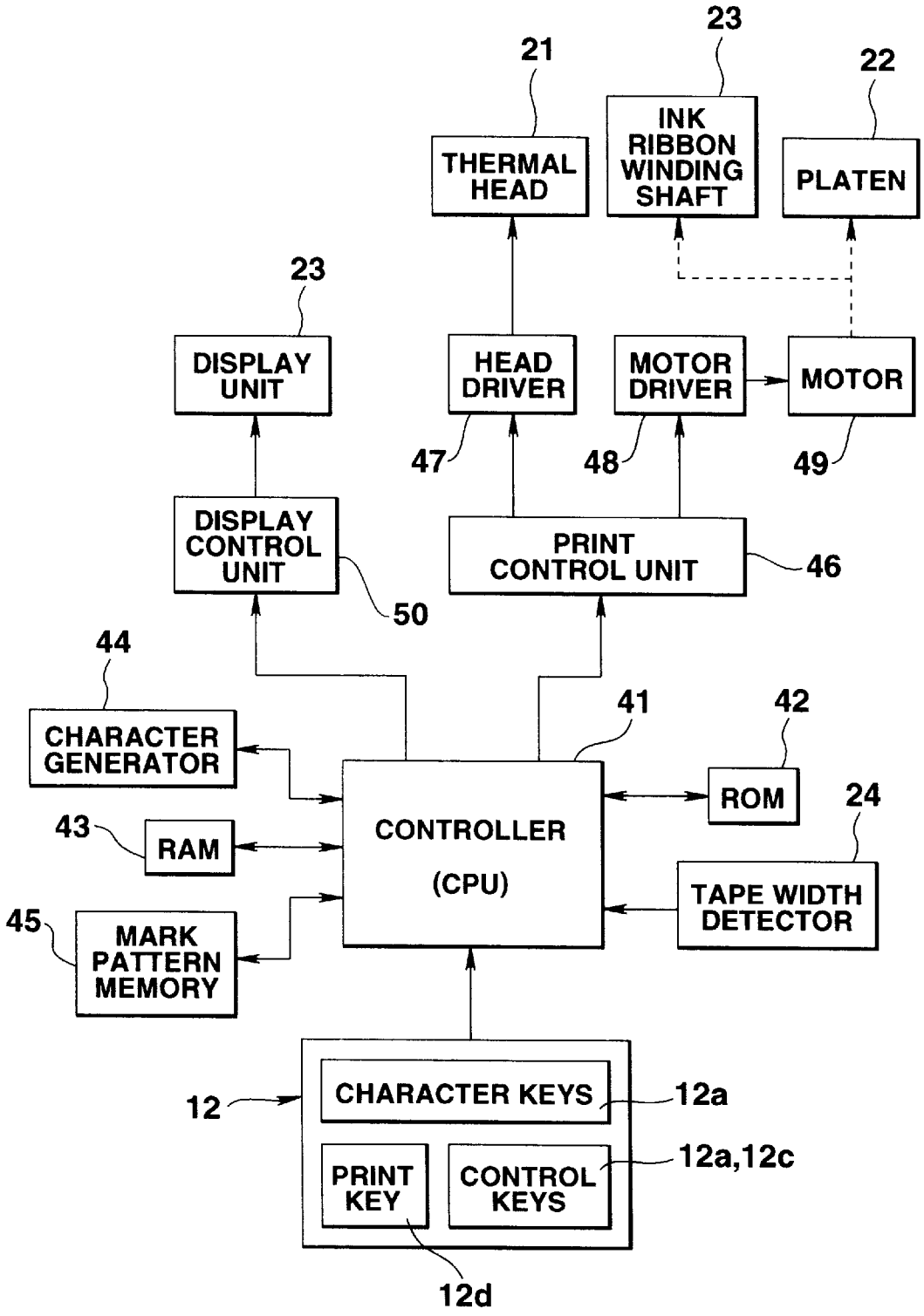
FIG. 3 is a block diagram of an electronic circuit of the tape printer.

FIG. 3 is a block diagram of an electronic circuit of the tape printer. The electronic circuit of the tape printer is provided with a controller (CPU) 41, which starts up a system program-stored beforehand in a ROM 42 in accordance with a key-in signal from the key-in unit 12 to control the respective operations of the circuit elements. The controller 41 is connected to the key-in unit 12, ROM 42, RAM 43, character generator 44, a mark pattern memory 45, cassette type detection switches 24, a printer control unit 46 which is connected via a head driver 47 to the thermal head 21 and via a motor driver 48 to a motor 49, which drives the platen roller 22 and ink ribbon winding shaft 23.

The ROM 42 contains a program which controls the inputting operation of text data in various data input modes, a program which controls enlarged label printing process and others, and a system control program which controls the system with the controller 41.

The character generator 44 contains character pattern data corresponding to all characters, symbols and command codes which are enterable by the key-in unit 12.

The print control unit 46 drives the motor 49 via the motor driver 48 to rotate the platen roller 22 and ink ribbon winding shaft 23 in synchronism with the thermal head 21 printing print data read out from RAM 43, one line data at a time on the tape T in accordance with print starting. Thus, the tape T is fed out and discharged one line at a time from the tape cassette 30 as the one line data is printed.

Figure 4:
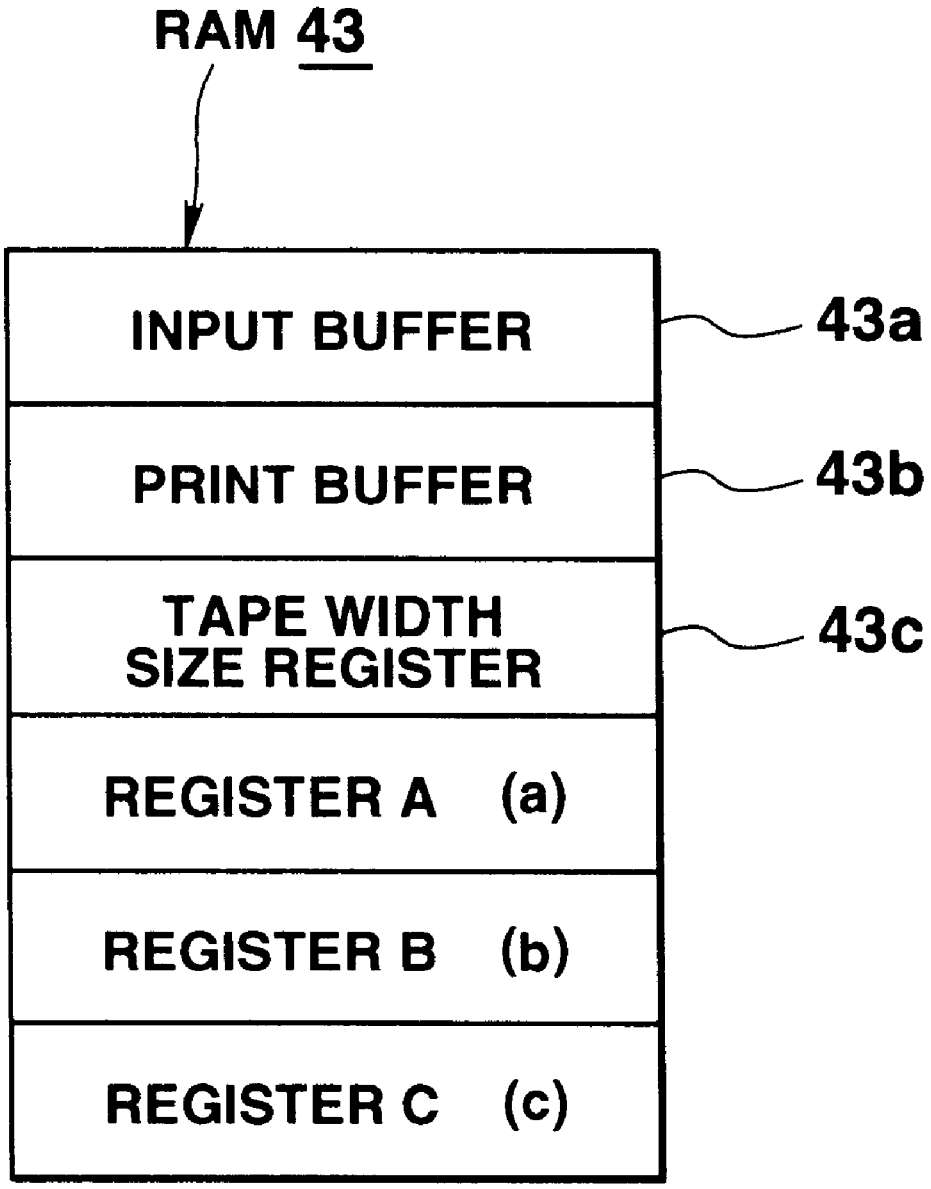
FIG. 4 shows the arrangement of data registers provided in a RAM of the tape printer.

FIG. 4 shows the arrangement of data registers provided in the RAM 43, which is provided with an input buffer 43*a*, print buffer 43*b*, tape width size register 43*c*, and registers A, B and C.

The input buffer 43*a* stores data entered by the key-in unit 12 in the form of a character or control code.

The print buffer 43*b* stores print pattern data output to the line-type heat producing elements of the thermal head 21.

The tape width size register 43*c* stores data on the size of the tape width determined depending on the type of a tape cassette 30 detected by the cassette type detection switches 24.

The register A stores division count data a representing the number of portions of print data, such as a character string whose enlarged printing is specified to produce an enlarged label, into which the print data is divided through its height to print the divided character string portions on corresponding lengthwise and successively arranged areas or sections of the tape T.

The register B stores print count data b representing the total number of print data portions, enlarged and printed so far and next, of the print data whose enlarged printing was specified.

The register C stores specified data c representing any particular one of the plurality of divided print data portions specified optionally for printing.

The mark pattern memory 45 stores a pattern of a mark which represents the order of arrangement of each of a plurality of labels, in a direction of label width, obtained by cutting off a corresponding plurality of areas or sections of the tape T on which the print data whose enlarged printing is specified is divided and printed, the mark being also used to align the plurality of labels in the direction of the width of the labels.

In this case, a pattern of a mark printed on a respective one of the tape sections (labels) is stored as having the number of dots which varies depending on the order of arrangement of that label.

The operation of the tape printer, thus constructed, will be described next.

FIG. 5 is a flow chart of a printing process performed in the tape printer.

FIGS. 6A–6F each show a display screen state of the display unit 13 appearing in the printing process of the tape printer.

Figure 7A:
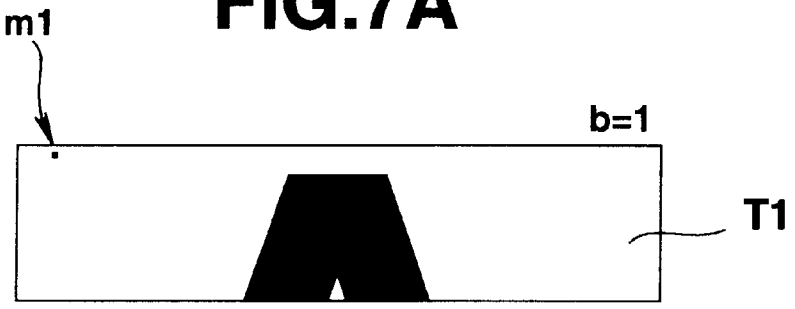
FIGS. 7A–7C each show a print output state obtained in an enlarged-label printing process performed in the tape printer.
Figure 7B:
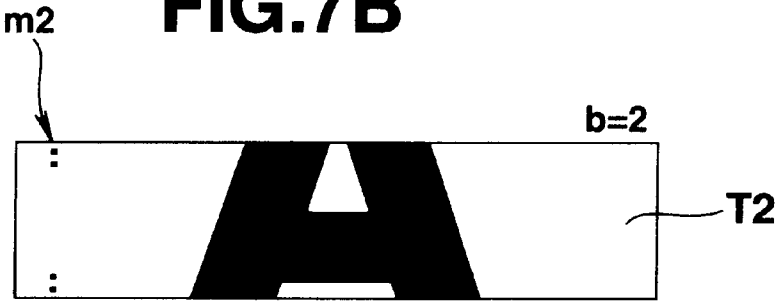
Figure 7C:
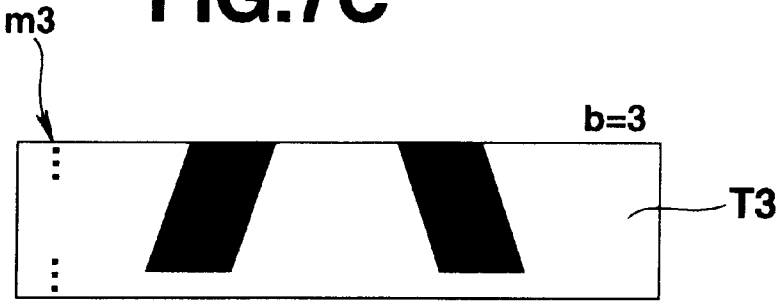

FIGS. 7A–C each show a print output state obtained in an enlarged-label printing process performed in the tape printer.

When the character keys 12*a* and control keys 12*b*, 12*c* of the key-in unit 12 are selectively operated to enter character data, for example, of "A" to display same on the display unit 13, the entered character data "A" is stored as corresponding character code data in the input buffer 43*a* of RAM 43.

Figure 6A:
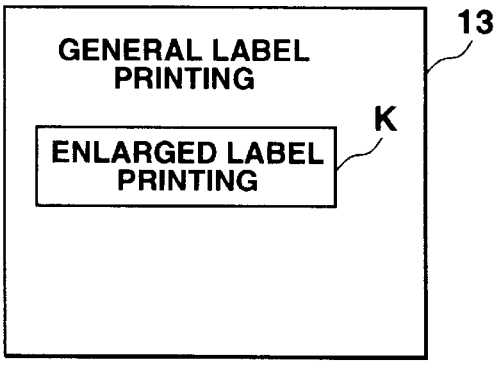
FIGS. 6A–6F each show a display screen state of a display unit appearing in the printing process of the tape printer.

When the print key 12*d* is then operated to print the data, thus entered and stored, the printing process of FIG. 5 is started up. First, as shown in FIG. 6A, a print type select screen which requests a user to select one of general label printing and enlarged label printing is displayed on the display unit 13 (step S1). The general label printing implies printing of data in a character size such as a standard one whose height falls within the width of the tape T set in the tape printer. The enlarged label printing implies dividing a character string (or character) of a general size into a plurality of character portions through the height of the character string (or character), enlarging the height of the respective character string (or character) portions to the height of the tape, and printing the plurality of character portions on a corresponding plurality of print areas or sections arranged lengthwise on the tape T to cut, arrange the printed tape sections in the direction of the tape width, and combine the arranged tape sections into an enlarged-character string (or character) label.

When the "general label printing" is selected by a cursor K on the print type select screen of the display unit 13 of FIG. 6A and execution of its printing is instructed, a font pattern-corresponding to the character code data as print data stored in the input buffer 43*a* of RAM 43 is called from the character generator 44 and transferred to the print buffer 43*b*, the font pattern transferred to the print buffer 43*b* is read out one-line data at a time and outputted to the print control unit 46, and printed on the tape T from the head driver 47 via the thermal head 21 (step S2→S3).

In this case, each time the thermal head 21 prints one-line data, the motor drive 48 drives the motor 49 to rotate the platen roller 21 and the ink ribbon winding shaft 23, and carries the tape T and ink ribbon R one dot line at a time, so that the print data "A" is printed sequentially one line data at a time in a character size, for example a standard one, which falls within the width of the tape T.

Figure 6B:
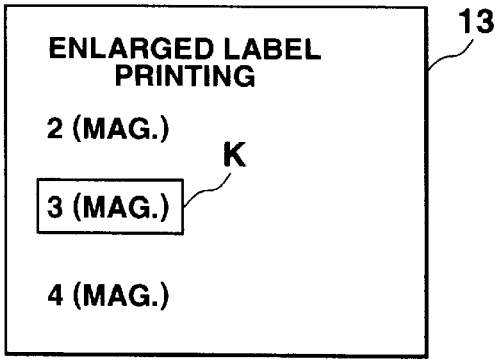

When the "enlarged label printing" is selected with the cursor K and execution of printing is instructed on the print type select screen of the display unit 13 of FIG. 6A, an enlargement magnification select screen which requests the user to select the number of labels into which the print data "A" is divided for enlarged printing is displayed on the display unit 13, as shown in FIG. 6B (step S2→S4). FIG. 6B shows that any one of three magnifications "2"–"4" is selectable, that is, that the print data can be divided into 2, 3 or 4 data portions to be printed on the corresponding labels.

When the cursor K is moved to the position, for example, of the magnification "3" and execution is instructed on the enlarged magnification select screen to perform enlarged printing in a size corresponding to three times the width of the tape T, division count data a for the enlarged printing is set as "3" in the register A of the RAM 43 (step S5→S6b).

Figure 6C:
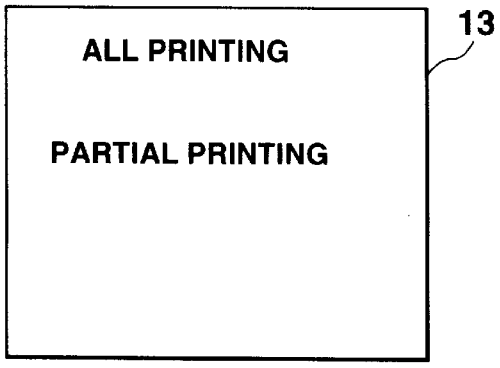

In response to this operation, a select print display screen which requests the user to select one of "all printing" and "partial printing" is displayed on the display unit 13, as shown in FIG. 6C (step S7). The "all printing" implies printing all the respective data portions (or pattern data portions or print data portions) into which the print data is divided for the enlarged printing. For example, when the enlarged magnification "3" is specified in FIG. 6B, the divided print data portions are printed on all of the three labels. The "partial printing" implies printing one of the print data portions (pattern data portions or print data portions) into which the print data was divided for the enlarged printing. For example, when the enlarged magnification "3" is specified in FIG. 6B, only one of the three data portions is printed on a label.

When the cursor K is moved to the position, for example, of "all printing" and execution is instructed on the print range select display screen of FIG. 6C to print all the enlarged print data portions, the print count data b indicating the total number of tape sections printed so far and to be printed next is first set at "1" in the register B of RAM 43 (step S8→S9).

In response to this operation, an upper one-third portion of the font pattern corresponding to the print data "A" stored in the character generator 44 is read in accordance with the division count data a (=3) set in the register A and the print count data b (=1) set in the register B, and is enlarged so as to be printed on the tape to the full width of the tape T data on which is stored in the tape width register 43*c*. Data on a mark (m1 in FIG. 7) composed of a one-dot pattern indicating that print pattern data portion (or pattern data portion) to be enlarged corresponds to a first enlarged-print label to be arranged is read from the mark pattern memory 45 and combined with the print pattern data portion at a predetermined position along the length of the tape section on which the print pattern data portion is printed, and the resulting data is stored in the print buffer 43*b* (step S10).

In response to this operation, first print pattern data portion (print data portion), specified by the print count data b set in the register B, and corresponding mark pattern data are outputted sequentially one line data at a time from the print buffer 43*b* to the print control unit 46 and printed on a tape section T1, as shown in FIG. 7A (step S11).

Figure 6D:
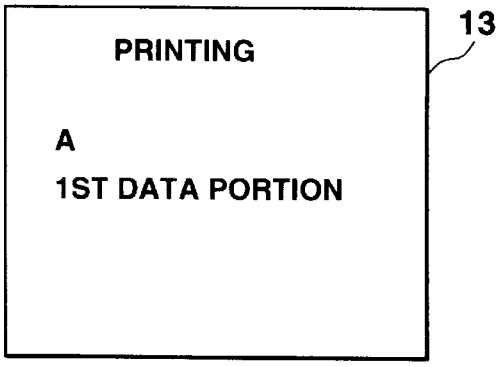

In this case, as shown in FIG. 6D, a "printing" display screen indicating that the first portion of the enlarged print data "A" is now printing is displayed on the display unit 13.

Figure 6E:
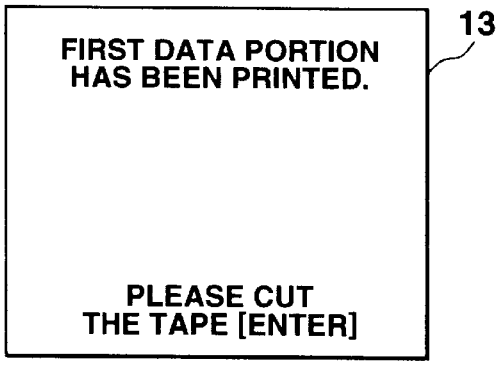

In response to this operation, the print count data b set in the register B is incremented by one to become "2" which indicates printing of the next second print data portion and, as shown in FIG. 6E, a tape cut request display screen is displayed which indicate the first print data potion has been printed and should be cut (steps S12, S13).

When the cutter operation dial 17 is then operated to operate the cutter 26, the tape section T1 on which the first print data portion is printed is cut off, as shown in FIG. 7A.

After cutting the tape section, the user operates a predetermined key of the key-in unit 12 by which the controller 41 determines that the tape cutting has completed (step S14).

When the controller 41 then determines that the print count data b (=2) set in the register B is less than the division count data a (=3) set in the register A, the controller 41 enlarges a second or intermediate divided portion of the font pattern of the print data "A" to the full tape width whose data is stored in the tape width register 43*c* in accordance with division count data a (=3) set in the register A and the print count data b (=2) set in the register B, and a mark m2 of a 2-dot pattern indicating that the second font pattern portion should be secondly arranged is combined with the second enlarged font pattern portion at a predetermined position along the length of the tape section on which the second enlarged font pattern portion is printed, and the resulting data is stored in the print buffer 43*b* (step S14→S15→S10).

In response to this operation, a second print data portion specified by the print count data b set in the register B, and the corresponding mark data are outputted sequentially one line data at a time from the print buffer 43*b* to the print control unit 46 and printed as a tape section T2, as shown in FIG. 7B (step S11).

In response to this operation, the print count data b set in the register B is incremented by one to become "3" which indicates printing the next third print data portion and a tape cut request display screen is displayed which indicates that the second print data potion has been printed and should be cut (steps S12, S13).

When the cutter operation dial 17 is then operated to operate the cutter 26, the tape section T1 on which the second print data portion is printed is cut off, as shown in FIG. 7B (step S14).

Then, when the user operates the predetermined key, and the controller 41 determines that the tape cutting has completed, the controller 41 then determines that the print count data b (=3) set in the register B is less than the division count data a (=3) set in the register A, the controller 41 enlarges a third or lowest divided portion of the font pattern of the print data "A" to the full tape width whose data is stored in the tape width register 43*c* in accordance with the division count data a (=3) set in the register A and the print count data b (=3) set in the register B, and a mark m3 of a 3-dot pattern indicating that the third font pattern portion should be thirdly arranged is combined with the third enlarged font pattern portion at a predetermined position along the length of the tape section on which the third enlarged font pattern portion is printed, and the resulting data is stored in the print buffer 43*b* (step S14→S15→S10).

In response to this operation, a third print pattern data portion (print data portion) specified by the print count data b set in the register B, and the corresponding mark data are outputted sequentially one line data at a time from the print buffer 43*b* to the print control unit 46 and printed as a tape section T2, as shown in FIG. 7C (step S11).

In response to this operation, the print count data b set in the register B is incremented by one to become "4" which indicates printing of the next fourth print data portion and a tape cut request display screen is displayed which indicates that the third print data potion has been printed and should be cut (steps S12, S13).

When the cutter operation dial 17 is then operated to operate the cutter 26, the tape section T3 on which the third print data portion is printed is cut off, as shown in FIG. 7C (step S14).

When the controller then determines that the print count data b (=4) set in the register B is not less than the division count data a (=3) set in the register A, the controller terminates the series of enlarged printing processes in which the print data is divided into the three portions, enlarged and printed (step S15→END).

Figure 8:
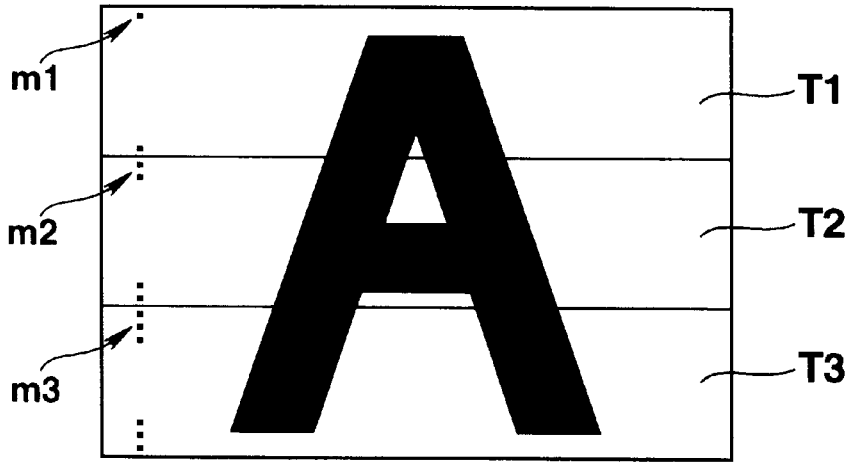
FIG. 8 shows a combination of tapes printed and output in the enlarged-label printing process performed in the tape printer.

FIG. 8 shows a combination of tape sections (labels) printed and outputted in the enlarged label printing process performed in the tape printer.

More particularly, as shown in FIGS. 7A–C, the three tape sections T1, T2 and T3 on which the three divided enlarged print data portions are printed are arranged, and aligned in the direction of the tape width in accordance with marks M1, M2 and M3 printed simultaneously at the predetermined positions along the respective lengths of the tape section T1, T2 and T3 to easily complete an enlarged printed data "A".

Figure 6F:
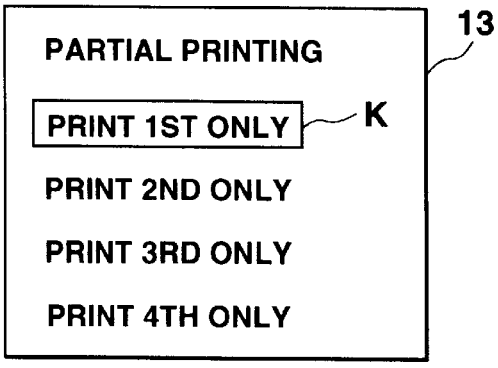

When the cursor K is moved to the position, for example, of "partial printing" and execution is instructed to specify and print one of the divided print data portions which compose the enlarged print data on the print range select screen of FIG. 6C, a partial print specifying request display screen is displayed which requests the user to specify which of the three divided enlarged print data portions should be printed, as shown in FIG. 6F (steps S7, S8→S16).

When the cursor K is moved to the position, for example, of "print first only" which represents printing a first print data area only and execution is instructed on the partial print specifying request display screen if it is desired to do so, the data c in the register C of RAM 43 is set at "1", the height of the upper one-third area of the font pattern of the print data "A" is enlarged to the width of the tape T data on which is stored in the tape width size register 43*c*, and the mark m1 indicating as a one-dot pattern that the enlarged first one-third font pattern area is first to be arranged is combined with the enlarged first one-third font pattern at a predetermined position along the length of the tape section on which the enlarged first one-third font pattern is printed (step S17→S18*a*→S19).

In response to this operation, the first one-third font pattern data portion specified by the specified order data c set in the register C is outputted sequentially one-line data at a time to the print control unit 46 and printed on the tape section T1 alone, as shown in FIG. 7A (step S20).

That is, only a print (font pattern) data portion having any specified order is selectively printed. For example, even when the tape T fails during printing of a particular one of the enlarged print data portions in the all-printing operation or when the printing of that particular enlarged print data portion is unsatisfactory, only the appropriate print data portion can be easily re-printed.

In the partial print specifying request display screen of FIG. 6F, at least one print data portion may be specified for printing. For example, two print data portions may be specified for printing purposes.

While in the example of FIG. 6F an area of a print data portion has been specified, the order of a data portion to be printed may be specified.

Thus, according to the inventive tape printer, when print data is enlarged and printed on a label of a size corresponding to three times the width of the tape T, print data portions printed on three corresponding tape sections T1, T2 and T3 are combined with corresponding marks m1, m2 and m3 indicating the order and positions of arrangement of the respective print data portions, and the resulting data are printed on the tape sections T1, T2 and T3 at predetermined positions along the respective lengths of the tape sections T1, T2 and T3. Thus, even when the number of tape sections where the enlarged divided print data portions are printed increases, it is clearly known where the respective tape sections (labels) should be arranged among them, and the respective labels are easily aligned mutually.

According to the present tape printer, of arranged print data portions which compose print data whose width is enlarged to any number times the tape width, any particular print data portion of any order of arrangement can be specified and printed. Thus, for example, even when the tape fails during printing of any particular print data portion or any particular one of the print data portions is unsuccessful, only that print data portion can be re-printed easily on a tape without reprinting all the print data portion.

Figure 9:
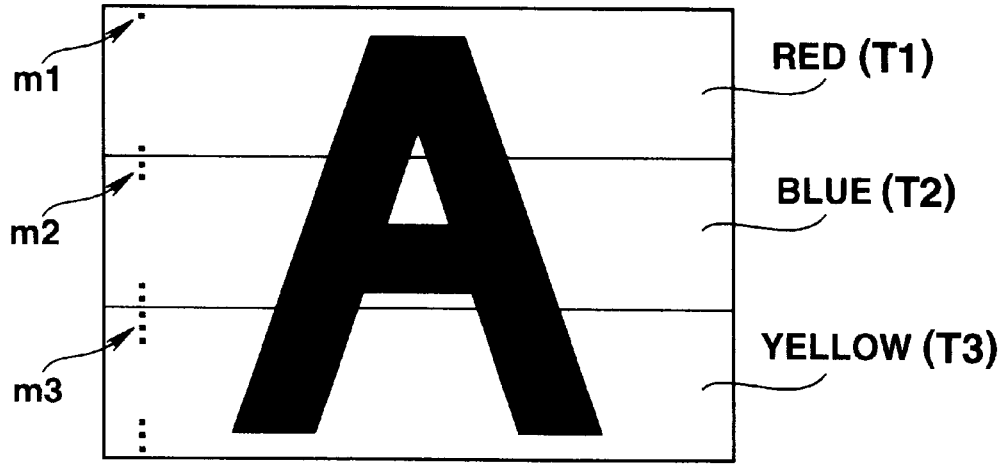
FIG. 9 shows an example of an enlarged label composed of different color tape sections obtained in the enlarged label printing process performed in the tape printer.

FIG. 9 shows a combination of enlarged print data portions printed on different color tape sections T. According to the present tape printer, the respective print data portions of the enlarged print data can be printed separately. Thus, for example, if a plurality of different types of tape cassettes 30 different in tape color are replaced sequentially for the respective print data portions, ornamentally excellent enlarged print data is obtained, as shown in FIG. 9, which shows tape sections (labels) T1, T2 and T3 produced by replacing sequentially three types of tape cassettes which contain red, blue and yellow tapes and printing first, second and third print data portions on the red, blue and yellow tape sections with a black ink ribbon. Alternatively, a plurality of tapes different in pattern or a plurality of ink ribbons different in color may be used.

While in the embodiment the printing of an enlarged character whose width exceeds the tape width has been described, a character whose width sufficiently within the width of the tape may be used to perform divisional printing. For example, "ABC", "DEF" and "GHI" may be printed in three rows on tape sections so as to fall within the tape width, along with marks for aligning the characters printed on those three tape sections and for determining the order of arrangement of those tape sections.

I claim:

1. A tape printer comprising:

input means for entering character data to be printed;

a print head having a plurality of heat producing elements arranged across a tape;

enlarged-character print specifying means for specifying an enlarged-character printing process in which the character data entered by said input means is printed in an enlarged character size whose height exceeds a width of the tape;

print data producing means, responsive to the enlarged-character print specifying means specifying the enlarged-character printing process, for: (i) dividing the character data entered by said input means in a lateral direction to produce a plurality of character pattern data portions each having an increased size corresponding to the tape width, and (ii) synthesizing the plurality of character pattern data portions and a corresponding plurality of mark data to produce a corresponding plurality of print pattern data portions, said mark data representing an order of arrangement of the print pattern data portions for aligning the print pattern data portions; and print control means for feeding the plurality of print pattern data portions produced by said print data producing means to said print head to cause said print head to print the plurality of print pattern data portions lengthwise on the tape as a plurality of respective labels which may be laterally arranged, in accordance with said mark data, to produce the enlarged character data.

2. The tape printer according to claim 1, wherein said plurality of mark data are each provided at a predetermined position relative to a respective one of the plurality of print pattern data portions, and wherein said plurality of mark data each comprise a number of dots which varies depending on the order of arrangement of the print pattern data portions.

3. The tape printer according to claim 1, further comprising detecting means for detecting the width of the tape; and wherein said print data producing means comprises:

character pattern storage means for prestoring the character pattern data portions corresponding to the character data entered by said input means;

enlarging means for reading and enlarging parts of the character pattern data stored in said character pattern storage means based on the enlarged character size specified by said enlarged character print specifying means and the tape width detected by said detecting means; and data synthesizing means for synthesizing the parts of the character pattern data enlarged by said enlarging means and the corresponding mark data to produce the corresponding plurality of print pattern data portions.

4. A tape printer according to claim 3, further comprising mark data storage means for storing patterns of the mark data.

5. A tape printer comprising:

a tape cassette containing a tape;

a print head for printing character data on the tape;

input means for entering the character data;

enlarged character print specifying means for specifying an enlarged character printing process in which the character data entered by said input means is divided into a plurality of print data portions, and the plurality of print data portions are printed in an enlarged character size having a height which exceeds a width of the tape;

print range specifying means, responsive to said enlarged character print specifying means specifying the enlarged character printing process, for specifying a print range of the character data entered by said input means to be printed in the enlarged character size for any one of the plurality of print data portions;

print data producing means for producing print pattern data by enlarging the print range of a part of pattern data corresponding to the character data entered by said input means and specified by said print range specifying means, in accordance with the enlarged character size specified by said enlarged print specifying means; and print control means for feeding the print pattern data produced by said print data producing means to said print head to cause said print head to print the print data portions lengthwise on the tape while carrying the tape lengthwise;

wherein the tape printer is adapted to receive a plurality of different types of the tape cassette, each of which contains a tape of a different color, so that specific print data portions may be sequentially printed on respective different color tapes.

6. The tape printer according to claim 5, further comprising detecting means for detecting the width of the tape contained in the tape cassette by identifying a type of the tape cassette; and wherein said print data producing means comprises:

character pattern storage means for pre-storing the pattern data corresponding to character data entered by said input means;

enlarging means for partially reading and enlarging parts of the pattern data stored in said character pattern storage means based on the enlarged character size specified by said enlarged character print specifying means and the tape width detected by said detecting means; and data synthesizing means for synthesizing the parts of the pattern data enlarged by said enlarging means with corresponding mark data representing an order of arrangement of the print data portions for aligning the print data portions.

* * * * *